US010677072B2

(12) United States Patent
Ju

(10) Patent No.: US 10,677,072 B2
(45) Date of Patent: Jun. 9, 2020

(54) BUCKET VIBRATION DAMPING STRUCTURE AND BUCKET AND TURBOMACHINE HAVING THE SAME

(71) Applicant: DOOSAN HEAVY INDUSTRIES & CONSTRUCTION CO., LTD., Changwon-si, Gyeongsangnam-do (KR)

(72) Inventor: Jae Min Ju, Changwon-si (KR)

(73) Assignee: Doosan Heavy Industries Construction Co., Ltd., Gyeongsangnam-do (KR)

( * ) Notice: Subject to any disclaimer, the term of this patent is extended or adjusted under 35 U.S.C. 154(b) by 99 days.

(21) Appl. No.: 15/919,212

(22) Filed: Mar. 13, 2018

(65) Prior Publication Data

US 2018/0283186 A1 Oct. 4, 2018

(30) Foreign Application Priority Data

Mar. 31, 2017 (KR) ..... 10-2017-0041742

(51) Int. Cl.
*F01D 5/22* (2006.01)

(52) U.S. Cl.
CPC ..... *F01D 5/225* (2013.01); *F05D 2240/24* (2013.01); *F05D 2260/96* (2013.01)

(58) Field of Classification Search
CPC ..... F01D 5/225
See application file for complete search history.

(56) References Cited

U.S. PATENT DOCUMENTS 4,710,102 A * 12/1987 Ortolano ..... F01D 5/225 416/190
4,840,539 A * 6/1989 Bourcier ..... F01D 5/225 416/191
5,257,908 A * 11/1993 Ortolano ..... F01D 5/22 416/190

(Continued)

FOREIGN PATENT DOCUMENTS

EP 1512837 A1 3/2005
EP 2524759 A1 11/2012

(Continued)

OTHER PUBLICATIONS

European Search Report dated May 29, 2018 in corresponding European Patent Application No. 18163286.0.

*Primary Examiner* — Woody A Lee, Jr.
(74) *Attorney, Agent, or Firm* — Invenstone Patent, LLC

(57) ABSTRACT

Disclosed herein are a bucket vibration damping structure and a bucket and turbomachine having the same. The bucket vibration damping structure comprises a plurality of blades disposed on a plurality of buckets mounted on an outer peripheral surface of a rotor disk and a variable contact-type vibration damping means disposed on the plurality of blades and performing variable contact according to rotational speed of a rotor for damping vibration. The variable contact-type vibration damping means may comprise a first damping member disposed on one of the blades, and a second damping member disposed at a position corresponding to the first damping member on the other blade. According to the disclosure, it is possible to effectively damp vibration while performing variable contact according to the rotational speed of a turbine.

19 Claims, 3 Drawing Sheets

(56) References Cited

U.S. PATENT DOCUMENTS

| | | | | |
|---|---|---|---|---|
| 5,599,165 | A * | 2/1997 | Elaini | F01D 5/225 416/190 |
| 8,573,939 | B2 * | 11/2013 | Borufka | F01D 5/225 416/190 |
| 9,822,647 | B2 * | 11/2017 | Subbareddyar | F01D 5/225 |
| 10,125,613 | B2 * | 11/2018 | Savage | F01D 5/225 |
| 10,196,908 | B2 * | 2/2019 | Bielek | F01D 5/225 |
| 2006/0233641 | A1 * | 10/2006 | Lee | F01D 5/143 415/208.1 |
| 2012/0294729 | A1 * | 11/2012 | Szabo | B23K 9/044 416/241 R |
| 2015/0211373 | A1 | 7/2015 | Subbareddyar | |
| 2016/0369643 | A1 | 12/2016 | Kitagawa | |

FOREIGN PATENT DOCUMENTS

| | | | |
|---|---|---|---|
| JP | 2002-004802 | A | 1/2002 |
| JP | 2005-256786 | A | 9/2005 |
| JP | 2015075070 | A | 4/2015 |
| KR | 10-2012-0075490 | A | 7/2012 |

* cited by examiner

[FIG. 1]
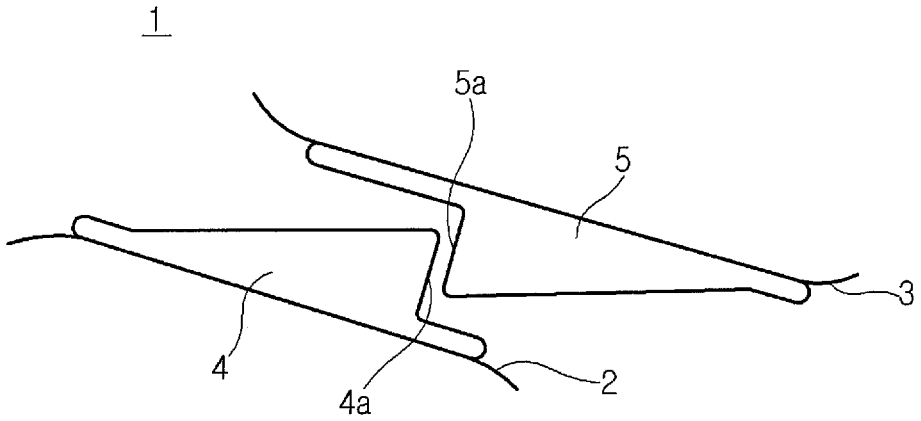
[FIG. 2]
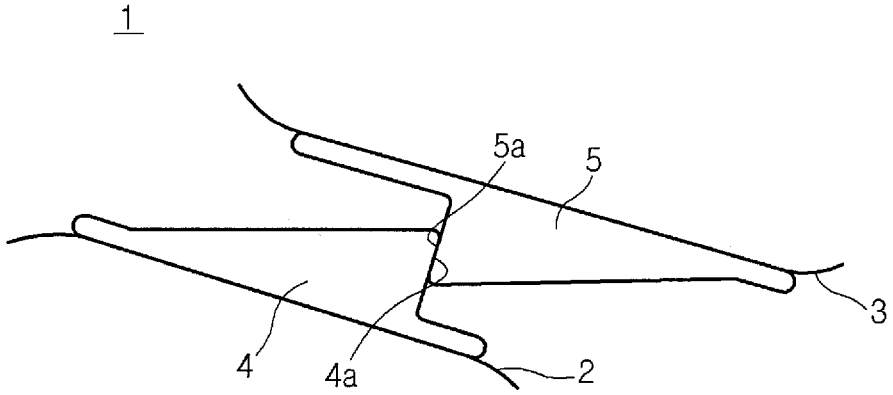

[FIG. 3]
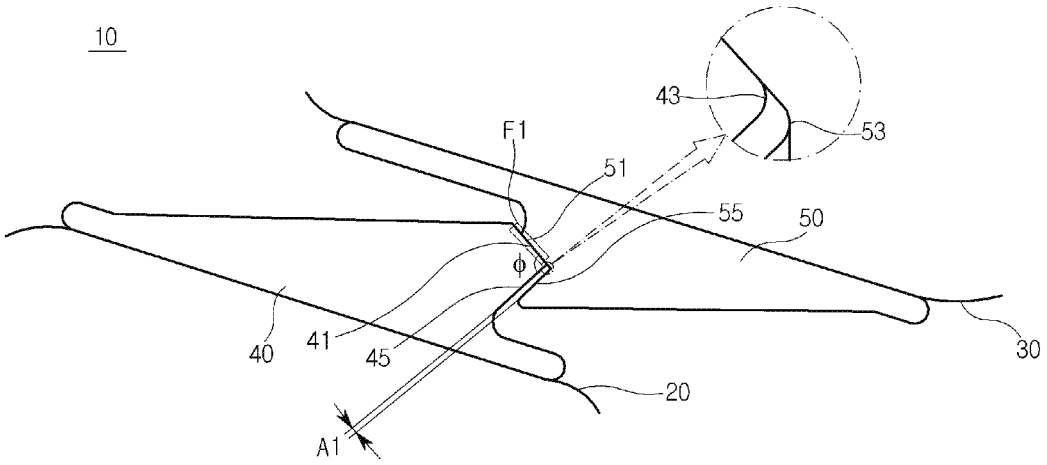
[FIG. 4]
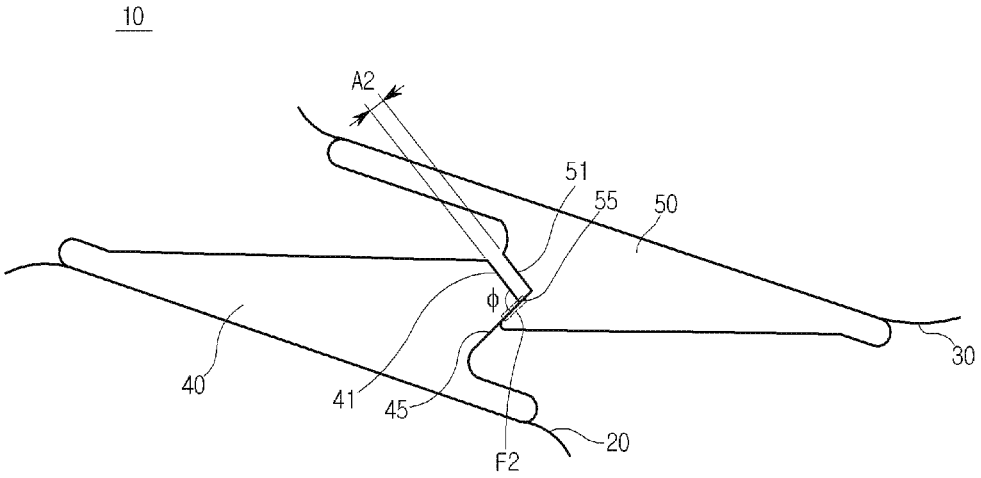
[FIG. 5]
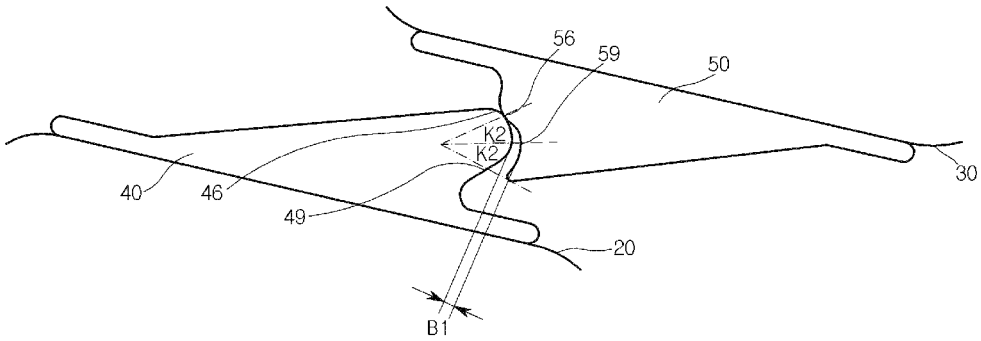

[FIG. 6]
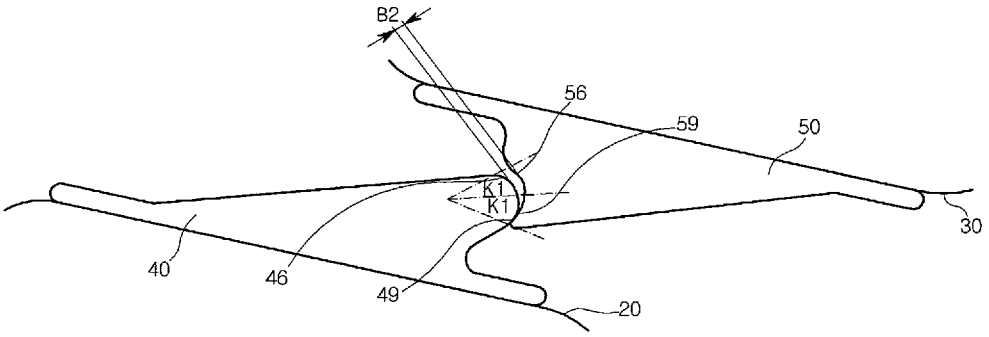
[FIG. 7]
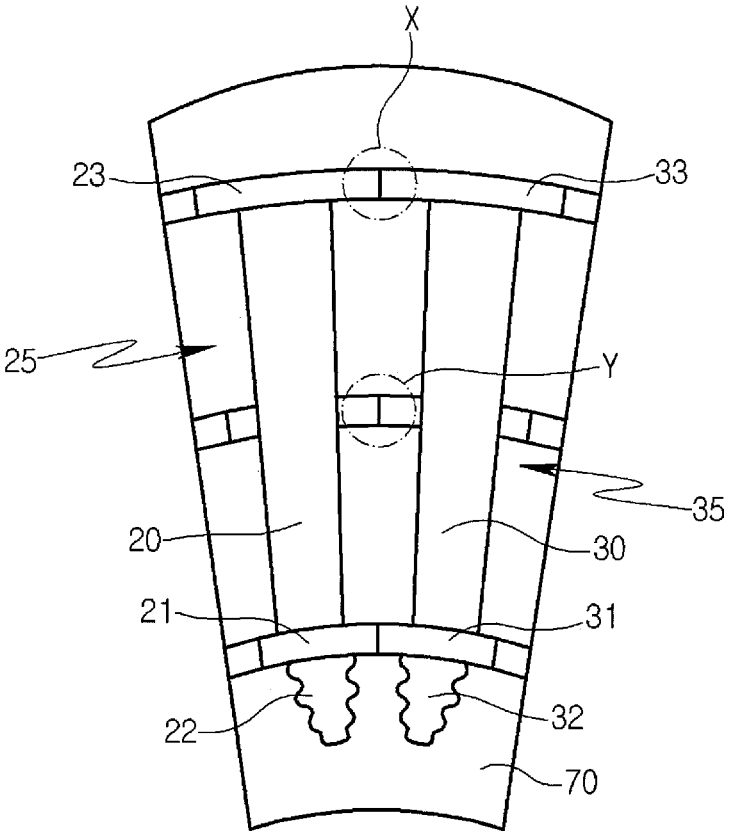

BUCKET VIBRATION DAMPING STRUCTURE AND BUCKET AND TURBOMACHINE HAVING THE SAME

CROSS-REFERENCE TO RELATED APPLICATIONS

This application claims priority to Korean Patent Application No. 10-2017-0041742, filed on Mar. 31, 2017, the disclosure of which is incorporated herein by reference in its entirety.

BACKGROUND OF THE DISCLOSURE

Field of the Disclosure

Exemplary embodiments of the present disclosure relate to a bucket vibration damping structure and a bucket and turbomachine having the same, and more particularly, to a structure capable of damping vibration while performing variable contact according to the rotational speed of a turbine.

Description of the Related Art

In general, turbines are power generation apparatuses that convert thermal energy of fluid, such as gas or steam, into rotational force as mechanical energy, and each comprises a rotor having a plurality of buckets to axially rotate by fluid and a casing installed to surround the rotor and having a plurality of diaphragms.

Among these turbines, a gas turbine comprises a compressor section, a combustor, and a turbine section. In the gas turbine, outside air is sucked and compressed by the rotation of the compressor section and is then transferred to the combustor, and combustion is performed by mixing the compressed air with fuel in the combustor. The high-temperature and high-pressure gas generated in the combustor drives a generator by rotating a rotor of the turbine while passing through the turbine section.

In a steam turbine, a high-pressure turbine section, an intermediate-pressure turbine section, and a low-pressure turbine section are interconnected in series or in parallel to rotate the rotor. When the high-pressure turbine section, the intermediate-pressure turbine section, and the low-pressure turbine section are interconnected in series, these share one rotor.

In the steam turbine, each turbine has a diaphragm and a bucket with the rotor in a casing interposed therebetween. Steam rotates the rotor while passing through the diaphragm and the bucket, thereby enabling the generator to be driven.

FIGS. 1 and 2 illustrate connections between blades on a bucket disposed on the outer peripheral surface of a rotor disk.

The bucket generally comprises a coupling part that is coupled to the outer peripheral surface of the rotor disk in a dovetail manner. The coupling part has a platform formed at one end thereof, and the blades are disposed on the platform. FIGS. 1 and 2 illustrate connections 4 and 5 between a plurality of blades 2 and 3.

When a turbine rotates at a low speed, the connections 4 and 5 are separated from each other with a certain gap therebetween, as illustrated in FIG. 1. When the turbine exceeds a constant speed while rotating at a high speed, the bucket is deformed so that the respective contact surfaces 4*a* and 5*a* of the connections 4 and 5 come into contact with each other, as illustrated in FIG. 2, thereby relieving vibration occurring at high speed.

SUMMARY OF THE DISCLOSURE

Since unexpected vibration by fluid often occurs in a turbomachine, it is necessary to relieve the vibration for power generation efficiency and damage prevention of the bucket. However, since the connections are separated from each other at a low speed in the related art, there is a problem in that vibration occurring at the low speed is not relieved.

The present disclosure has been made in view of the above-mentioned problem, and an object thereof is to provide a structure capable of damping vibration while performing variable contact according to the rotational speed of a turbine.

Other objects and advantages of the present disclosure can be understood by the following description, and become apparent with reference to the embodiments of the present disclosure. Also, it is obvious to those skilled in the art to which the present disclosure pertains that the objects and advantages of the present disclosure can be realized by the means as claimed and combinations thereof.

The present disclosure is directed to a bucket vibration damping structure and a bucket and turbomachine having the same. In accordance with one aspect of the present disclosure, the bucket vibration damping structure comprises a variable contact-type vibration damping means disposed on a plurality of bucket blades mounted on an outer peripheral surface of a rotor disk and performing variable contact according to rotational speed of a rotor for damping vibration, wherein the variable contact-type vibration damping means comprises a first damping member disposed on one of the blades, and a second damping member disposed at a position corresponding to the first damping member on the other blade.

The first damping member may comprise a first tangential portion disposed on one blade and protruding toward the other adjacent blade, and a second tangential portion forming a certain angle with the first tangential portion and disposed adjacent thereto on one blade.

Each of the first and second tangential portions may have a flat shape.

The first and second tangential portions may form an angle of 90° to 120° with each other.

The first and second tangential portions may have adjacent rounded portions.

The second damping member may comprise a first facing portion protruding toward the first tangential portion on the other adjacent blade, and a second facing portion forming a certain angle with the first facing portion and disposed adjacent thereto.

Each of the first and second facing portions may have a flat shape.

The first and second facing portions may form an angle of 90° to 120° with each other.

An amount of overlap between the first tangential portion and the first facing portion when they come into contact with each other may differ from an amount of overlap between the second tangential portion and the second facing portion when they come into contact with each other.

The amount of overlap between the second tangential portion and the second facing portion when they come into contact with each other may be greater than the amount of overlap between the first tangential portion and the first facing portion when they come into contact with each other.

An amount of gap between the first tangential portion and the first facing portion when they are not in contact with each other may differ from an amount of gap between the second tangential portion and the second facing portion when they are not in contact with each other.

The amount of gap between the second tangential portion and the second facing portion when they are not in contact with each other may be greater than the amount of gap between the first tangential portion and the first facing portion when they are not in contact with each other.

The first damping member may comprise a first curved portion disposed on one blade and rounded toward the other adjacent blade, and a second curved portion disposed adjacent to the first curved portion.

The first and second curved portions may have the same curvature.

The second damping member may comprise a first facing curved portion disposed on the other adjacent blade and rounded toward the first curved portion, and a second facing curved portion forming a certain angle with the first facing curved portion and disposed adjacent thereto.

The first and second facing curved portions may have the same curvature.

The curvature of the first and second facing curved portions may be greater than the curvature of the first and second curved portions.

In accordance with another aspect of the present disclosure, the bucket comprises a blade provided with the bucket vibration damping structure, a platform, one end of which is provided with the blade, and a coupling part provided at the other end of the platform and mounted on an outer peripheral surface of a rotor disk.

The bucket vibration damping structure may be disposed on a shroud cover portion or an intermediate portion of the blade.

In accordance with a further aspect of the present disclosure, the turbomachine comprises a casing, a compressor having the bucket and disposed in the casing to compress air introduced thereinto, a combustor connected to the compressor in the casing to combust the compressed air, a turbine connected to the combustor in the casing to produce power using the combusted air, and a diffuser connected to the turbine in the casing to discharge the air to the outside.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The above and other objects, features and other advantages of the present disclosure will be more clearly understood from the following detailed description taken in conjunction with the accompanying drawings, in which:

FIG. 1 is a view illustrating a conventional vibration damping structure in a non-contact state at a low speed;

FIG. 2 is a view illustrating a conventional vibration damping structure in a contact state at a high speed;

FIG. 3 is a view illustrating a vibration damping structure in a contact state at a low speed according to a first embodiment of the present disclosure;

FIG. 4 is a view illustrating a vibration damping structure in another contact state at a high speed according to the first embodiment of the present disclosure;

FIG. 5 is a view illustrating a vibration damping structure in a contact state at a low speed according to a second embodiment of the present disclosure;

FIG. 6 is a view illustrating a vibration damping structure in another contact state at a high speed according to the second embodiment of the present disclosure; and FIG. 7 is a view illustrating that the vibration damping structure of the present disclosure is positioned on a blade.

DESCRIPTION OF SPECIFIC EMBODIMENTS

Reference will now be made in detail to exemplary embodiments of the present disclosure, examples of which are illustrated in the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Throughout the disclosure, like reference numerals refer to like parts throughout the various figures and embodiments of the present disclosure.

Hereinafter, a bucket vibration damping structure and a bucket and turbomachine having the same according to exemplary embodiments of the present disclosure will be described in detail with reference to the accompanying drawings.

Prior to description of exemplary embodiments of the present disclosure, the structure of a gas turbine, which is an example of a turbomachine pertaining to the present disclosure, will be described. However, the present disclosure may also be applied to other gas turbines and should not be construed as limited to the structure set forth hereinafter.

The gas turbine pertaining to the present disclosure comprises a compressor, a combustor, and a turbine as basic components.

First, the gas turbine has a casing corresponding to the body thereof. The compressor is disposed forward in the casing and the turbine is disposed rearward in the casing. The combustor is connected between the compressor and the turbine through respective passages in the casing.

Based on the flow direction of air, outside air is introduced into a compressor section disposed upstream of the gas turbine for an adiabatic compression process. The compressed air is introduced into a combustor section to be mixed with fuel for an isobaric combustion process. The combustion gas is introduced into a turbine section disposed downstream of the gas turbine for an adiabatic expansion process.

The combustion used to produce power in the turbine is discharged to outside through an exhaust diffuser disposed in the rear of the casing.

In this case, the compressor and the turbine are interconnected by one rotor shaft for rotation together.

Typically, the gas turbine provided in a power plant is continuously driven to produce power. Therefore, the integral connection of the compressor and the turbine by a single rotor shaft may be suitable for manufacturing costs and management.

In more detail, a plurality of disks is mounted on the outer peripheral surface of the rotor shaft disposed in the compressor section, and a plurality of buckets corresponding to rotary wings is radially arranged on the disks.

In an axial type coupling method, each of the buckets has a lower end processed in a dovetail form so that it is inserted into and coupled to a bucket mounting portion, which is formed on the outer peripheral surface of the associated disk, in the axial direction of the rotor shaft.

In another tangential type coupling method, the bucket is fitted into and coupled to the bucket mounting portion in the circumferential direction of the rotor disk.

A platform is formed at the upper end of the bucket, and a blade is disposed on the platform.

In this case, a plurality of disk diaphragms is fixedly arranged in rows on the inner peripheral surface of the casing, and a plurality of vanes or nozzles is radially arranged on the diaphragms. Each of the diaphragms has a hole formed at the center thereof such that the rotor shaft may be disposed therein.

The air introduced from outside is compressed by mutual rotation of the vanes or nozzles disposed on the diaphragms and the buckets.

The combustor section is disposed between the compressor section and the turbine section in the casing and is connected therebetween.

In the combustor section, a plurality of combustors is arranged in a shell form in the radial direction of the casing. Each of the combustors may comprise a burner that has a fuel injection nozzle and an ignition plug, an inner liner that defines a combustion chamber, a flow sleeve that guides the flow of combustion gas, and a transition piece that allows combustion gas to flow to the turbine section, etc.

The air, which is compressed in and introduced from the compressor section, is mixed with fuel injected from the combustor section for combustion and then flows to the turbine section.

In addition, a plurality of turbine wheels is disposed on the outer peripheral surface of the rotor shaft disposed in the turbine section, and a plurality of turbine blades corresponding to rotary wings is radially arranged on the turbine wheels.

In this case, a plurality of disk diaphragms is fixedly arranged in rows on the inner peripheral surface of the casing, and a plurality of vanes or nozzles is radially arranged on the diaphragms. Each of the diaphragms has a hole formed at the center thereof such that the rotor shaft may be disposed therein.

The combustion gas generated in the combustors is expanded by mutual rotation of the vanes or nozzles disposed on the diaphragms and the turbine blades and is used to produce power in the turbine section.

Then, the combustion gas having passed through the turbine section is discharged through the exhaust diffuser disposed in the rear of the casing.

Here, the gas turbine used in a combined generation system is configured such that the exhaust gas discharged from the exhaust diffuser is introduced into a steam turbine via heat exchangers for another power generation.

In this case, the pressure and velocity of the exhaust gas discharged from the exhaust diffuser may be important factors. Therefore, the exhaust gas must be introduced into the steam turbine at constant pressure and velocity for smooth operation of the system.

Hereinafter, in the present disclosure, the non-rotation component such as a casing, a diaphragm, or a combustor is referred to as a fixed unit or a stator, and the rotation component such as a rotor shaft, a compressor, or a turbine is referred to as a rotating unit or a rotor.

First Embodiment

FIG. 3 is a view illustrating a vibration damping structure in a contact state at a low speed according to a first embodiment of the present disclosure. FIG. 4 is a view illustrating a vibration damping structure in another contact state at a high speed according to the first embodiment of the present disclosure.

Referring to FIGS. 3 and 4, the vibration damping structure, which is designated by reference numeral 10, according to the first embodiment of the present disclosure comprises a variable contact-type vibration damping means 11 that is disposed on a plurality of bucket blades 20 and 30 mounted on the outer peripheral surface of a rotor disk. The vibration damping structure performs a variable contact according to the rotational speed of a rotor for damping vibration. The variable contact-type vibration damping means 11 may comprise a first damping member 40 that is disposed on one of the blades, and a second damping member 50 that is disposed at a position corresponding to the first damping member 40 on the other blade.

In the first embodiment of the present disclosure, the first damping member 40 comprises a first tangential portion 41 and a second tangential portion 45, and the second damping member 50 comprises a first facing portion 51 and a second facing portion 55.

The first tangential portion 41 may be disposed on one blade 20 and protrude toward the other adjacent blade 30, and the second tangential portion 45 may form a certain angle with the first tangential portion 41 and be disposed adjacent thereto on the blade 20.

In this case, the first and second tangential portions 41 and 45 may have a flat shape, which is to relieve vibration by forming contact surfaces with the first and second facing portions 51 and 55 as described below.

The first and second tangential portions 41 and 45 form a certain angle $\phi$ with each other. The certain angle $\phi$ may be determined corresponding to the deformation of a bucket, the shape of which is deformed by a rotary force according to the increase or decrease of the rotational speed of a turbine.

In the first embodiment of the present disclosure, the certain angle $\phi$ may be within a range of 90 to 120 degrees. In this case, even though the first and second tangential portions 41 and 45 come into the variable contact with the first and second facing portions 51 and 55 within a variation range of rotational speed (e.g., within a range of 1800 to 3600 rpm), the contact area of the overlap portion therebetween may be constantly maintained. Therefore, it may be possible to prevent the mutual separation between the first damping member 40 and the second damping member 50 even though the bucket is deformed.

In addition, the first and second tangential portions 41 and 45 have rounded portions 43 at the adjacent portions thereof. Thus, the first and second tangential portions 41 and 45 are smoothly movable even when they come into the variable contact with the first and second facing portions 51 and 55.

The first facing portion 51 may protrude toward the first tangential portion 41 on the other adjacent blade 30, and the second facing portion 55 may form a certain angle with the first facing portion 51 and be disposed adjacent thereto.

In this case, the first and second facing portions 51 and 55 may have a flat shape, which is to relieve vibration by forming contact surfaces with the first and second tangential portions 41 and 45.

The first and second facing portions 51 and 55 form a certain angle $\phi$ with each other. The certain angle $\phi$ may be determined corresponding to the deformation of the bucket, the shape of which is deformed by rotary force according to the increase or decrease of the rotational speed of the turbine. In addition, the certain angle ϕ may correspond to the angle formed by the first and second tangential portions 41 and 45.

In the first embodiment of the present disclosure, the certain angle ϕ may be within a range of 90 to 120 degrees. In this case, even though the first and second tangential portions 41 and 45 come into the variable contact with the first and second facing portions 51 and 55 within the variation range of rotational speed (e.g., within a range of 1800 to 3600 rpm), the contact area of the overlap portion therebetween may be constantly maintained. Therefore, it may be possible to prevent the mutual separation between the first damping member 40 and the second damping member 50 even though the bucket is deformed.

In addition, the first and second facing portions 51 and 55 have rounded portions 53 at the adjacent portions thereof. Thus, the first and second facing portions 51 and 55 are smoothly movable even when they come into variable contact with the first and second tangential portions 41 and 45.

Here, the first and second damping members 40 and 50 may be configured such that an amount of overlap F1 between the first tangential portion 41 and the first facing portion 51 when they come into contact with each other differs from an amount of overlap F2 between the second tangential portion 45 and the second facing portion 55 when they come into contact with each other.

This amount of overlap may be determined according to the degree of vibration caused by the rotational speed of the turbine. At a low speed, the vibration due to the impact with fluid is small since the rotational speed of the turbine is low. Thus, for relieving the vibration, the contact area between the damping members is relatively small.

At the high speed, the vibration due to the impact with fluid is large since the rotational speed of the turbine is high. Thus, for relieving the vibration, the contact area between the damping members is relatively large.

Accordingly, in the first embodiment of the present disclosure, the amount of overlap F2 between the second tangential portion 45 and the second facing portion 55 when they come into contact with each other may be greater than the amount of overlap F1 between the first tangential portion 41 and the first facing portion 51 when they come into contact with each other.

In addition, the first and second damping members 40 and 50 may be configured such that an amount of gap A2 between the first tangential portion 41 and the first facing portion 51 when they are not in contact with each other differs from an amount of gap A1 between the second tangential portion 45 and the second facing portion 55 when they are not in contact with each other.

This amount of gap may be determined according to the deformation of the bucket by the rotational speed of the turbine. The deformation of the bucket is further increased when the turbine rotates at the high speed. Therefore, in the first embodiment of the present disclosure, the amount of gap A1 between the second tangential portion 45 and the second facing portion 55 when they are not in contact with each other may be greater than the amount of gap A2 between the first tangential portion 41 and the first facing portion 51 when they are not in contact with each other.

As illustrated in FIG. 7, the vibration damping structure 10 may be disposed on cover portions X of shrouds 23 and 33 disposed at the ends of blades 20 and 30 of buckets 25 and 35 or on intermediate portions Y of the blades 20 and 30. The blades 20 and 30 are disposed on platforms 21 and 31, and male dovetail coupling parts 22 and 32 may be formed at the other sides of the platforms 21 and 31 so as to be coupled to the outer peripheral mounting portion of a rotor disk 70.

The present disclosure may comprise these buckets. The present disclosure also pertains to a turbomachine comprising a casing, a compressor which has the buckets and is disposed in the casing to compress air introduced thereinto, a combustor which is connected to the compressor in the casing to combust the compressed air, a turbine which is connected to the combustor in the casing to produce power using the combusted air, and a diffuser which is connected to the turbine in the casing to discharge the air to outside.

Second Embodiment

FIG. 5 is a view illustrating a vibration damping structure in a contact state at a low speed according to a second embodiment of the present disclosure. FIG. 6 is a view illustrating a vibration damping structure in another contact state at a high speed according to the second embodiment of the present disclosure.

Referring to FIGS. 5 and 6, the vibration damping structure, which is designated by reference numeral 10, according to the second embodiment of the present disclosure comprises a variable contact-type vibration damping means 11 that is disposed on a plurality of bucket blades 20 and 30 mounted on the outer peripheral surface of a rotor disk and performs variable contact according to the rotational speed of a rotor for damping vibration. The variable contact-type vibration damping means 11 comprises a first damping member 40 that is disposed on one of the blades, and a second damping member 50 that is disposed at a position corresponding to the first damping member 40 on the other blade.

In the second embodiment of the present disclosure, the first damping member 40 comprises a first curved portion 46 and a second curved portion 49, and the second damping member 50 comprises a first facing curved portion 56 and a second facing curved portion 59.

The first curved portion 46 may be disposed on one blade 20 and be rounded toward the other adjacent blade 30, and the second curved portion 49 may be disposed adjacent to the first curved portion 46.

In this case, the first and second curved portions 46 and 49 may have a semi-circular shape, which is to relieve vibration by forming contact surfaces with the first and second facing curved portions 56 and 59 as described below.

The first and second curved portions 46 and 49 have the same curvature K1, which is to smoothly move when they form the contact surfaces with the first and second facing curved portions 56 and 59. That is, even though the first and second curved portions 46 and 49 come into a variable contact with the first and second facing curved portions 56 and 59 within a variation range of rotational speed (e.g., within a range of 1800 to 3600 rpm), the contact area of the overlap portion therebetween may be constantly maintained by virtue of the same curvature. Therefore, it may be possible to prevent the mutual separation between the first damping member 40 and the second damping member 50 even though the bucket is deformed.

The first facing curved portion 56 may be rounded toward the first curved portion 46 on the other adjacent blade 30, and the second facing curved portion 59 may be disposed adjacent to the first facing curved portion 56.

In this case, the first and second facing curved portions 56 and 59 may have the same curvature K2, which is to relieve vibration by forming contact surfaces with the first and second curved portions 46 and 49. In addition, the same curvature allows the first and second facing curved portions 56 and 59 to smoothly move.

Even though the first and second curved portions 46 and 49 come into the variable contact with the first and second facing curved portions 56 and 59 within a variation range of rotational speed (e.g., within a range of 1800 to 3600 rpm), the contact area of the overlap portion therebetween may be constantly maintained. Therefore, it may be possible to prevent the mutual separation between the first damping member 40 and the second damping member 50 even though the bucket is deformed.

Here, the first and second damping members 40 and 50 may be configured such that the curvature K2 of the first and second facing curved portions 56 and 59 is greater than the curvature K1 of the first and second curved portions 46 and 49.

This may be enable the first and second damping members to come into the variable contact with each other with respect to the increase or decrease of the rotational speed of the turbine by forming a gap which is a non-contact area therebetween. To this end, the curvature K2 is greater than the curvature K1.

In addition, the first and second damping members 40 and 50 may be configured such that an amount of gap B2 between the first curved portion 46 and the first facing curved portion 56 when they are not in contact with each other differs from an amount of gap B1 between the second curved portion 49 and the second facing curved portion 59 when they are not in contact with each other.

This amount of gap may be determined according to the deformation of the bucket by the rotational speed of the turbine. The deformation of the bucket is further increased when the turbine rotates at the high speed. Therefore, in the second embodiment of the present disclosure, the amount of gap B1 between the second curved portion 49 and the second facing curved portion 59 when they are not in contact with each other may be greater than the amount of gap B2 between the first curved portion 46 and the first facing curved portion 56 when they are not in contact with each other.

As illustrated in FIG. 7, the vibration damping structure 10 may be disposed on the cover portions X of the shrouds 23 and 33 disposed at the ends of the blades 20 and 30 of the buckets 25 and 35 or on the intermediate portions Y of the blades 20 and 30. The blades 20 and 30 are disposed on the platforms 21 and 31, and the male dovetail coupling parts 22 and 32 may be formed at the other sides of the platforms 21 and 31 so as to be coupled to the outer peripheral mounting portion of the rotor disk 70.

The present disclosure may comprise these buckets. The present disclosure also pertains to the turbomachine comprising the casing, the compressor which has the buckets and is disposed in the casing to compress air introduced thereinto, the combustor which is connected to the compressor in the casing to combust the compressed air, the turbine which is connected to the combustor in the casing to produce power using the combusted air, and the diffuser which is connected to the turbine in the casing to discharge the air to outside.

As is apparent from the above description, the present disclosure can damp vibration by connecting a plurality of blades while one surfaces thereof come into contact with each other at a low speed and can damp vibration by connecting the plurality of blades while the other surfaces thereof come into contact with each other when buckets are deformed by rotary force at a high speed.

In this case, since a different amount of overlap and a different amount of gap are applied to blades of adjacent respective buckets, it is possible to increase a vibration damping effect by friction between connections.

Ultimately, it is possible to improve the power generation efficiency of a turbine by effectively damping vibration caused when the turbine is operated.

While the bucket vibration damping structure and the bucket and turbomachine having the same according to the present disclosure have been described with respect to the specific embodiments, it will be apparent to those skilled in the art that various changes and modifications may be made without departing from the spirit and scope of the disclosure as defined in the following claims.

What is claimed is:

1. A structure for damping bucket vibration, the structure comprising:

a rotor disk configured to be driven at a rotational speed;

a plurality of bucket blades mounted on an outer peripheral surface of the rotor disk, the plurality of bucket blades including an adjacent pair of bucket blades, the adjacent pair of bucket blades including a first blade and a second blade; and a variable contact-type vibration damping means including first and second damping members respectively disposed on opposing surfaces of the first and second blades, the second damping member disposed at a position corresponding to the disposition of the first damping member, the variable contact-type vibration damping means configured to damp vibration generated in the driven rotor disk by performing variable contact between the first and second blades according to the rotational speed of the rotor disk, wherein the first damping member comprises a first tangential portion and a second tangential portion having one end communicating with the first tangential portion, the first tangential portion facing a first facing portion of the second damping member, the second tangential portion facing a second facing portion of the second damping member, and wherein the first and second damping members are configured to engage with each other at either of a low rotational speed of the rotor disk and a high rotational speed of the rotor disk such that, at the low rotational speed, the first tangential portion and the first facing portion make contact with each other at first variable contact surfaces and such that, at the high rotational speed, the second tangential portion and the second facing portion make contact with each other at second variable contact surfaces.

2. The structure according to claim 1, wherein the first tangential portion includes a first flat surface facing the first facing portion of the second damping member, and the second tangential portion includes a second flat surface facing the second facing portion of the second damping member.

3. The structure according to claim 2, wherein the first damping member further comprises a round portion communicating with each of the first flat surface of the first tangential portion and the second flat surface of the second tangential portion.

4. The structure according to claim 2, wherein the first and second flat surfaces form an angle that ranges from 90° to 120 °.

5. The structure according to claim 2, wherein the second flat surface of the second tangential portion is disposed on a line intersecting the opposing surface of the first blade.

6. The structure according to claim 2, wherein the first facing portion includes a third flat surface facing the first flat surface of the first tangential portion, and wherein the second facing portion includes a fourth flat surface facing the second flat surface of the second tangential portion, the fourth flat surface disposed on a line intersecting the opposing surface of the second blade.

7. The structure according to claim 6, wherein the third and fourth flat surfaces form an angle in correspondence to an angle formed by the first and second flat surfaces.

8. The structure according to claim 1, wherein the first and second damping members are further configured to varyingly engage with each other at either of the low rotational speed of the rotor disk and the high rotational speed of the rotor disk such that, at the low rotational speed, the first tangential portion and the first facing portion make contact with each other along a first contact area of the first variable contact surfaces having a first amount of overlap and such that, at the high rotational speed, the second tangential portion and the second facing portion make contact with each other along a second contact area of the second variable contact surfaces having a second amount of overlap that is different from the first amount of overlap.

9. The structure according to claim 8, wherein the second amount of overlap is greater than the first amount of overlap.

10. The structure according to claim 1, wherein the first and second damping members are configured to varyingly engage with each other at either of the low rotational speed of the rotor disk and the high rotational speed of the rotor disk such that, at the low rotational speed, the second tangential portion and the second facing portion do not make contact with each other and form a first amount of gap and such that, at the high rotational speed, the first tangential portion and the first facing portion do not make contact with each other and form a second amount of gap that is different from the first amount of gap.

11. The structure according to claim 10, wherein the first amount of gap is greater than the second amount of gap.

12. The structure according to claim 1, wherein each of the first and second blades comprises:

a platform coupled to the rotor disk;

an intermediate blade portion having a radially inner end coupled to the platform and a radially outer end formed opposite to the radially inner end; and a shroud disposed at the radially outer end of the blade, wherein the first and second damping members are respectively disposed on the shrouds of the first and second blades.

13. The structure according to claim 1, wherein each of the first and second blades comprises:

a platform coupled to the rotor disk;

an intermediate blade portion having a radially inner end coupled to the platform and a radially outer end formed opposite to the radially inner end; and a shroud disposed at the radially outer end of the blade, wherein the first and second damping members are respectively disposed on the intermediate blade portions of the first and second blades.

14. The structure according to claim 1, wherein the first tangential portion includes a first curved portion facing the first facing portion of the second damping member, and the second tangential portion includes a second curved portion facing the second facing portion of the second damping member, wherein the first curved portion includes a first convex surface facing a first concave surface of the second facing portion of the second damping member, and the second curved portion includes a second convex surface facing a second concave surface of the second facing portion of the second damping member, and wherein the first and second convex surfaces form a curvature having a first radius, and the first and second concave surfaces form a curvature having a second radius greater than the first radius.

15. The structure according to claim 14, wherein the first and second damping members are configured to varyingly engage with each other at either of the low rotational speed of the rotor disk and the high rotational speed of the rotor disk such that, at the low rotational speed, the second convex surface and the second concave surface do not make contact with each other and form a first amount of gap and such that, at the high rotational speed, the first convex surface and the first concave surface do not make contact with each other and form a second amount of overlap that is different from the first amount of overlap.

16. The structure according to claim 15, wherein the first amount of gap is greater than the second amount of gap.

17. The structure according to claim 1, wherein the rotor disk is further configured to be driven within a variation range of 1800 to 3600 rpm, the variation range including a low end and a high end, and wherein the first and second damping members are further configured to engage with each other at only one of the low end of the variation range and the high end of the variation range.

18. A structure for damping bucket vibration, the structure comprising:

a variable contact-type vibration damping means disposed on a plurality of bucket blades mounted on an outer peripheral surface of a rotor disk and configured to perform variable contact according to rotational speed of a rotor for damping vibration, the plurality of bucket blades including a first blade and a second blade, the variable contact-type vibration damping means comprising:

a first damping member that is disposed on the first blade and comprises first and second tangential portions, the first tangential portion disposed on the first blade to protrude toward the second blade, the second tangential portion disposed on the first blade adjacent to the first tangential portion so as to form an angle with the first tangential portion; and a second damping member that is disposed on the second blade at a position corresponding to the first damping member and comprises first and second facing portions, the first facing portion protruding toward the first tangential portion, the second facing portion disposed on the second blade adjacent to the first facing portion so as to form an angle with the first facing portion, wherein an amount of gap between the first tangential portion and the first facing portion when they are not in contact with each other differs from an amount of gap between the second tangential portion and the second facing portion when they are not in contact with each other.

19. A turbomachine comprising:

a compressor including a plurality of rotors configured to compress air introduced into the compressor;

a combustor to produce combustion gas by combusting the compressed air;

a turbine to produce power using the combustion gas, wherein each rotor of the plurality of rotors includes:

a rotor disk configured to be driven at a rotational speed; and a plurality of bucket blades mounted on an outer peripheral surface of the rotor disk, the plurality of bucket blades including an adjacent pair of bucket blades, the adjacent pair of bucket blades including a first blade and a second blade, and wherein the compressor further includes a structure for damping bucket vibration, the structure comprising:

a variable contact-type vibration damping means including first and second damping members respectively disposed on an opposing surface of each of the first and second blades, the second damping member disposed at a position corresponding to the disposition of the first damping member, the variable contact-type vibration damping means configured to damp vibration generated in the driven rotor disk by performing variable contact between the first and second blades according to the rotational speed of the rotor disk, wherein the first damping member comprises a first tangential portion and a second tangential portion having one end communicating with the first tangential portion, the first tangential portion facing a first facing portion of the second damping member, the second tangential portion facing a second facing portion of the second damping member, and wherein the first and second damping members are configured to engage with each other at either of a low rotational speed of the rotor disk and a high rotational speed of the rotor disk such that, at the low rotational speed, the first tangential portion and the first facing portion make contact with each other at first variable contact surfaces and such that, at the high rotational speed, the second tangential portion and the second facing portion make contact with each other at second variable contact surfaces.

* * * * *